US012252946B2

(12) United States Patent
Barron et al.

(10) Patent No.: US 12,252,946 B2
(45) Date of Patent: Mar. 18, 2025

(54) WELLBORE TUBULAR ANCHOR SUB AND SEAL FOR MODULAR COMPLETION INTERFACE

(71) Applicant: Halliburton Energy Services, Inc., Houston, TX (US)

(72) Inventors: Angus Barron, Aberdeenshire (GB); Borisa Lajesic, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/218,894

(22) Filed: Jul. 6, 2023

(65) Prior Publication Data

US 2025/0012157 A1 Jan. 9, 2025

(51) Int. Cl.
*E21B 23/06* (2006.01)
*E21B 33/124* (2006.01)
*E21B 43/14* (2006.01)

(52) U.S. Cl.
CPC ..... *E21B 23/06* (2013.01); *E21B 33/124* (2013.01); *E21B 43/14* (2013.01)

(58) Field of Classification Search
CPC ..... E21B 23/06; E21B 33/124; E21B 43/14
See application file for complete search history.

(56) References Cited

U.S. PATENT DOCUMENTS 1,941,813 A 3/1931 Nixon et al.
4,399,873 A * 8/1983 Lindsey, Jr. ..... E21B 23/06 166/212
4,497,371 A * 2/1985 Lindsey, Jr. ..... E21B 23/0413 166/212
4,681,159 A * 7/1987 Allwin ..... E21B 43/10 166/124
5,253,705 A * 10/1993 Clary ..... E21B 23/06 166/134
6,315,041 B1 * 11/2001 Carlisle ..... E21B 33/124 166/212
6,364,017 B1 * 4/2002 Stout ..... E21B 23/06 166/278

(Continued)

FOREIGN PATENT DOCUMENTS

CA 2644667 C 9/2006
CN 203175470 U 9/2013

(Continued)

OTHER PUBLICATIONS

Foreign Communication from Related Application—International Search Report and Written Opinion of the International Searching Authority, International Application No. PCT/US2023/027327, dated Mar. 20, 2024, 10 pages.

*Primary Examiner* — Steven A MacDonald
(74) *Attorney, Agent, or Firm* — Conley Rose, P.C.; Rodney B. Carroll

(57) ABSTRACT

A selective anchor assembly for a downhole completion comprising an anchor sub and a seal assembly with at least one seal unit. The anchor sub comprises at least one button slip within a corresponding piston port that is fluidically coupled to an inner passage of the anchor. The selective anchor is configured to slidingly and sealingly engage a polish bore of a downhole completion. The selective anchor is configured to anchor to a shroud coupled to the polish bore in response to pressure applied to the inner passage of the anchor sub.

24 Claims, 9 Drawing Sheets

(56) References Cited

U.S. PATENT DOCUMENTS

| | | | | |
|---|---|---|---|---|
| 8,590,608 | B2 * | 11/2013 | Linn | E21B 23/12 166/381 |
| 9,500,058 | B2 | 11/2016 | Tunc et al. | |
| 11,041,343 | B2 * | 6/2021 | Porbjörnsson | E21B 17/0423 |
| 2006/0289172 | A1 | 12/2006 | Miller et al. | |
| 2012/0261130 | A1 * | 10/2012 | Linn | E21B 41/0035 166/50 |
| 2018/0283140 | A1 * | 10/2018 | Steele | E21B 43/26 |
| 2018/0363389 | A1 * | 12/2018 | Porbjörnsson | F16L 15/00 |
| 2019/0186229 | A1 * | 6/2019 | Hrupp | E21B 33/124 |
| 2019/0352987 | A1 * | 11/2019 | Hrupp | E21B 23/00 |
| 2022/0412198 | A1 | 12/2022 | Steele et al. | |

FOREIGN PATENT DOCUMENTS

| | | | |
|---|---|---|---|
| CN | 111927363 | A | 11/2020 |
| RU | 2337231 | C1 | 10/2008 |
| WO | 2021211664 | A1 | 10/2021 |

* cited by examiner

WELLBORE TUBULAR ANCHOR SUB AND SEAL FOR MODULAR COMPLETION INTERFACE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons, such as oil and gas, are commonly obtained from subterranean formations that may be located onshore or offshore. The construction of a hydrocarbon producing well can comprise a number of different steps. Typically, the construction begins with drilling a wellbore at a desired wellsite, treating the wellbore to optimize production of hydrocarbons, and installing completion equipment to produce the hydrocarbons from the subterranean formation. During the construction of some wells, the wellbore may be completed in smaller stages or sub-stages. In some scenarios, the wellbore may be stimulated after the installation of a portion of the completion equipment or between sub-stages of completion equipment.

Well construction in tortuous or deep wells can require the installation of seal assemblies on long strings of tubing. The drilling operation may result in a long winding or wandering path that the stings of tubing are installed within. The location of a seal surface, e.g., polish bore, along or at the end of this irregular path can be difficult to determine requiring a long seal bore. Likewise, installing and/or retaining a seal assembly with the seal surface can be problematic. For example, temperature and/or pressure changes within the tubing, e.g., a stimulation operation, can result in the expansion and/or contraction of the tubing resulting in an unplanned disengagement of seals from the seal surface. A method of retaining the seal assembly within the seal bore is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
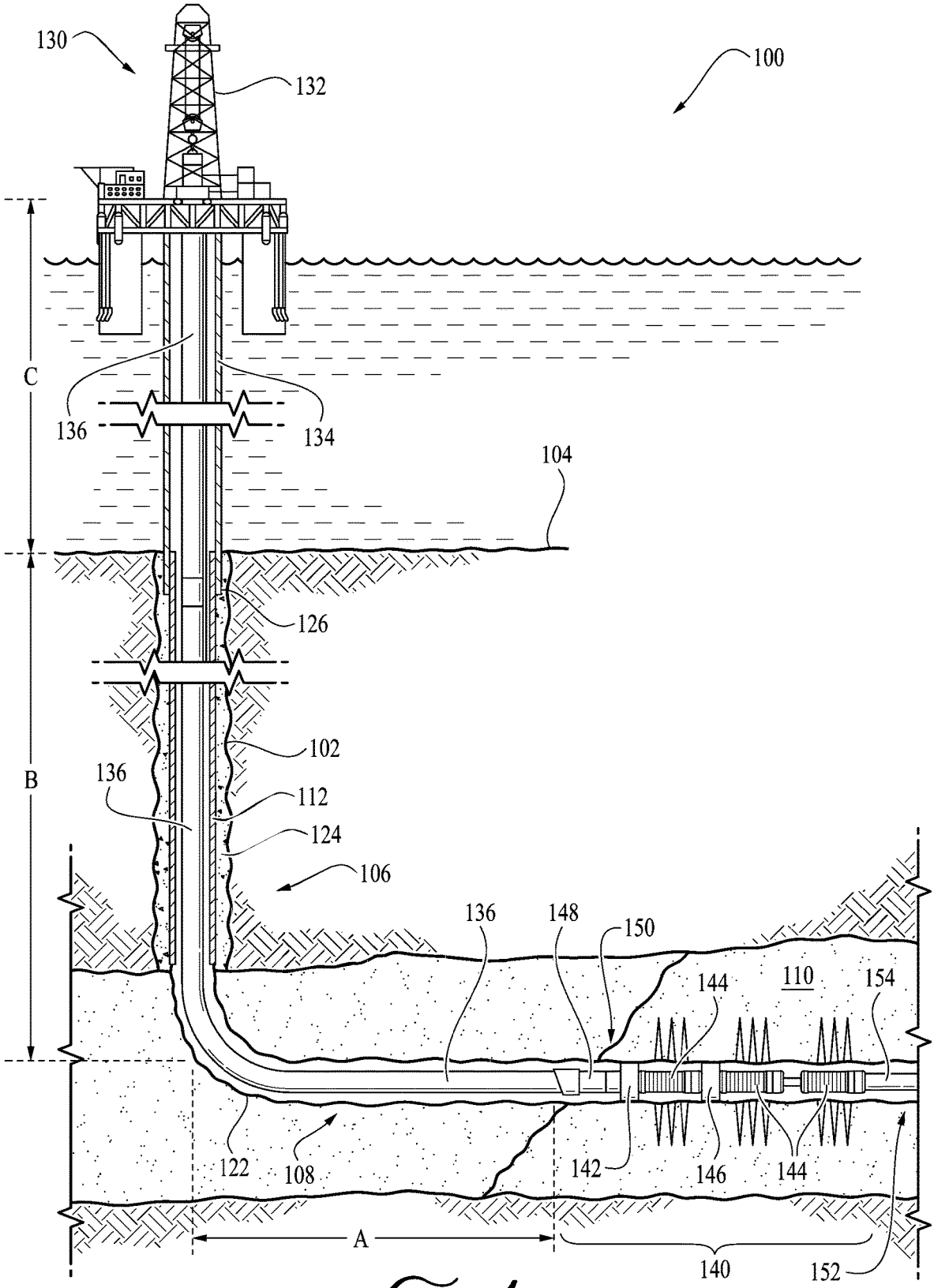
FIG. 1 is a diagram illustrating an exemplary environment for a selective anchor assembly according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "uphole," "downhole," "up," and "down" are defined relative to the location of the earth's surface relative to the subterranean formation. "Down" and "downhole" are directed opposite of or away from the earth's surface, towards the subterranean formation. "Up" and "uphole" are directed in the direction of the earth's surface, away from the subterranean formation or a source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Hydrocarbons, such as oil and gas, are produced or obtained from subterranean reservoir formations that may be located onshore or offshore. The development of subterranean operations and the processes involved in removing hydrocarbons from a subterranean formation typically involve a number of construction steps such as drilling a wellbore at a desired well site, isolating the wellbore with a barrier material, completing the wellbore with various production equipment, treating the wellbore to optimize production of hydrocarbons, and providing surface production equipment for the recovery of hydrocarbons from the wellhead.

During the completion operations, a completion string, for example, a packer and at least one sand screen, may be used to isolate a production zone when erosive sand particles are present or predicted within the fluids produced from the formation, e.g., production fluids. The completion operation can comprise and upper completion string and a lower completion string, also referred to as a lower completion assembly. Generally, a lower completion assembly comprises an isolation packer and at least one sand screen comprising a base pipe with a flow passage and a filter media, e.g., sand screen, disposed around a portion of the base pipe. The filter media can be formed with a filter flow area formed between the filter media and the base pipe. The isolation packer can anchor the lower completion and form a seal between the packer and the inner surface of the wellbore. The lower completion can also comprise a seal surface, e.g., a polish bore. A string of tubing comprising a seal assembly can locate and seal within the seal surface.

Wellbore operations can expose the lower completion to varied conditions, e.g., temperatures and pressures, and the seal assemblies must be suitable for either the resultant loads or pipe movement. For example, extended reach completions or multilateral completions can utilize lower completions divided into multiple sections, also referred to as drop-off sections, that include a seal surface, e.g., a polished bore. A completion seal interface, e.g., seal assembly, can be sealingly coupled to the polished bore to isolate another portion of the wellbore from this portion of the lower completion or to produce wellbore fluids to surface. However, given the nature of well construction these seal interfaces must account for a degree of variation in planned location of the polished bore, e.g., measure depth, due to the tortuous path of the wellbore and/or the extreme measured depth of the polished bore, for example, up to two meters travel uphole or downhole. This degree of variation, e.g., two meters of travel, can exclude the use of mechanically anchored seal assemblies, e.g., latch technology. Simulation operations can increase the complexity by adding additional tension and/or compression loading to the seal for loading on the string, for example, a stimulation operation can generate a temperature change of up to 100 C within the tubing. A temperature change experience during simulation operation can generate significant stress levels in a tubing string anchored to a lower completion as the tubing string expands and contracts. In response, an anchor is often removed or disengaged to allow the seal interface to float or move axially with tubing compression or tension, however this "float" exposes the plurality of tubulars and the connections between to tubulars to high piston loads which can result in mechanical failure. A completion interface that can sealingly couple to a polish bore and selectively anchor during simulation operations is desirable.

One solution to the problem of selectively anchoring can utilize a pressure sensitive mechanism. In some embodiments, a method of selectively anchoring tubing interfaces, e.g., conventional seal mandrels, with a pressure activated casing anchor device can activate, e.g., anchor, in response to pressure applied to the tubing string. For example, the tubing interfaces can "float" or stroke within the polish bore but can be locked, e.g., anchored, in place in response to applied pressure.

The method of selectively anchoring tubing interfaces can be beneficial when swellpackers, e.g., packers not anchored to the wellbore, are utilized in sections of drop-off liners and multilateral junction assemblies. In some embodiments, the method of selectively anchoring tubing interfaces comprises pressure activated slips and/or buttons. For example, applied pressure within the tubing string with the tubing interface can result in an upward, e.g., uphole direction, piston load and the selective anchoring mechanism can be activated extending the slips/buttons and anchoring the tubing string, e.g., tubing interface, to the lower completion portion, e.g., the polish bore. Once this pressure is reduced the slips/buttons will retract and the upper string will move back to its original as installed position. In some embodiments, the anchor will not activate during thermal changes, thus the tubing interface can float or stroke within the polish bore as a result of contraction of the tubing through cooling. In some embodiments, the internal pressure can be applied along with subsequent thermal cooling, the pressure activated anchor can activate to retain the tubing interface within the polish bore. By application of this method, interfaces between tubular sections, such as drop-off liner and multilateral completion junctions, can be further ruggedized ultimately increasing stimulation and production enhancement methods leading to greater well length and production life.

Turning now to FIG. 1, an exemplary wellsite environment 100 for a selective anchor is illustrated. In some embodiments, the wellsite environment 100 comprises a wellbore 102 extending from a surface location 104 to a permeable subterranean formation 110. The wellbore 102 can be drilled from surface location 104 using any suitable drilling technique. The wellbore 102 can include a substantially vertical portion 106 that transitions to a deviated portion and into a substantially horizontal portion 108. In some embodiments, the wellbore 102 may comprise a non-conventional, horizontal, deviated, multilateral, or any other type of wellbore. Wellbore 102 may be defined in part by a casing string 112 that may extend from a surface location, e.g., a wellhead 126, to a selected downhole location. The casing string 112 may be isolated from the wellbore by cement 124. Portions of wellbore 102 that do not comprise the casing string 112 may be referred to as open hole 122. Although the horizontal portion 108 is illustrated as an open hole portion 122, it is understood that the horizontal portion 108 can include a casing string 112 and/or cement 124. In some embodiments, a wellbore operation can be conducted from an offshore platform 130 comprising a lifting system 132, a fluid system, and a rotation mechanism. The lifting system can include a block and tackle system with a traveling block. A riser 134 can mechanically and fluidically couple the offshore platform 130 to the wellhead 126. While the wellsite environment 100 illustrates a subsea environment, the present disclosure contemplates any wellsite environment including a land based environment. In one or more embodiments, any one or more components or elements may be used with subterranean operations equipment located on offshore platforms, drill ships, semi-submersibles, drilling barges, and land-based rigs.

A production string 136 may be positioned within the wellbore 102 and extend from the offshore platform 130 into the subterranean formation 110. The production string 136 can be any piping, tubular, or fluid conduit including, but not limited to, drill pipe, production tubing, casing, coiled tubing, and any combination thereof. The production string 136 provides a conduit for production fluids extracted from the formation 110 to travel to the surface. The production string 136 may additionally provide a conduit for fluids to be conveyed downhole and injected into the formation 110, such as in an injection operation.

In some embodiments, the production string 136 can be releasably coupled to a lower completion 140. For example, the production string 136 can sealingly couple to the lower completion 140 by a completion interface (not shown). In some embodiments, the production string 136 can sealingly couple and mechanically couple to the lower completion 140 by a selective anchor as will be described further herein. The lower completion 140 can divide the production zone into various production intervals adjacent the formation 110. The production zone can be the area within the wellbore 102 where various wellbore operations are to be undertaken using the lower completion 140, such as production or injection operations.

As illustrated in FIG. 1, the lower completion 140 comprises a seal surface 148, an isolation packer 142, and a plurality of sand control screen assemblies 144 axially offset from each other along portions of the lower completion 140. The isolation packer 142 can anchor and seal the lower completion 140 within the production zone. A zonal packer 146 can be placed between each screen assembly 144 to form a seal between the outer surface of the lower completion 140 and the inner surface of the wellbore 102 thereby defining corresponding production intervals. The seal surface 148, e.g., polish bore, can be coupled to the isolation packer 142 or generally located at the uphole end 150 of the lower completion 140. In some embodiments, the lower completion 140 can comprise more than one sub-assembly or partial lower completion. For example, the lower completion 140, as illustrated in FIG. 1, can couple to another lower completion portion via a completion interface 154 located at a downhole end 152 or distal end to the lower completion 140.

In some embodiments, a tubing string with a completion interface can extend from the rig 130 to the lower completion 140. In a first scenario, the tubing string can be the production string 136 configured to sealingly couple to the polish bore 148 of the lower completion 140. The production string 136 can fluidically couple the formation 110 to a surface production facility (not shown) via the lower completion 140. In a second scenario, the tubing string can be a service string, e.g., drill pipe or heavy weight tubing, configured to sealingly couple to the polish bore 148. For example, the tubing string can be conveyed into the wellbore 102 to sealingly engage the polish bore 148 for testing of the annulus between the tubing string and wellbore 102 or simulation of the wellbore 102. In both scenarios, the tubing string 136 may be conveyed from the rig floor of the rig 130 to the lower completion 140 located at the distal end of the wellbore 102.

The measured depth, e.g., total distance, from the rig floor to the lower completion 140 can be in a range of 30,000 feet to 40,000 feet. The measured depth can include "A" lateral distance along the generally horizontal portion 108, "B" a target depth measured along the generally vertical portion 106, and "C" a water depth measured from the rig floor to the surface location 104 of the sea-bed. For example, horizontal wells in the United States averaged 10,000 ft in early 2000s and 18,000 by 2019 in lateral length, e.g., "A" lateral distance, according to the US Energy Information Administration. The target depth, e.g., "B" target depth, is generally the average depth of the subterranean formation 110 from the surface 104. For example, the US average depth of exploratory and development wells on US land was 5,500 feet during the 2000s. The water depth "C" can depend on the type of offshore platform 130 utilized. For example, "C" water depth can be 200 feet to 1,700 feet for a fixed platform, 200 feet to 20,000 feet for a semi-submersible platform, or up to 12,100 feet for a drillship.

Figure 2A:
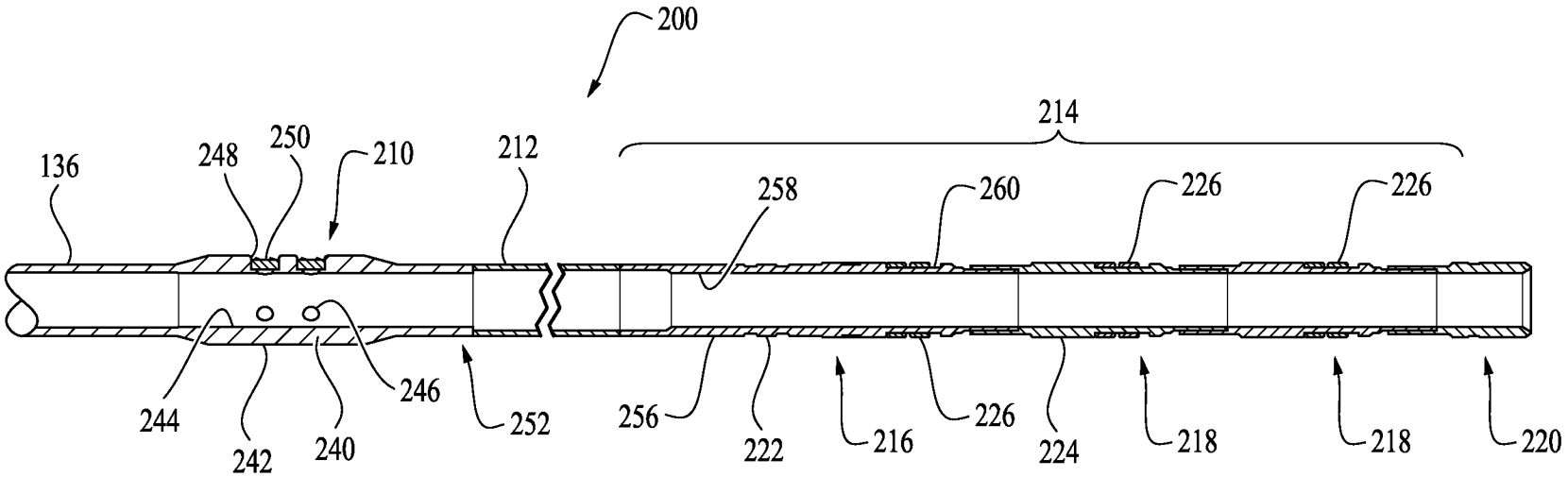
FIG. 2A is a partial cross-sectional view of the selective anchor assembly according to an embodiment of the disclosure.

Turning now to FIG. 2A, a selective completion interface can be described. In some embodiments, a selective completion interface, e.g., selective anchor 200, can comprise an anchor sub 210 and a seal assembly 214. The anchor sub 210 can comprise a sub body 240 and plurality of button slips 250. The sub body 240 be a generally cylinder shape with an outer surface 242, an inner surface 244, and a plurality of fluid ports 246. The plurality of button slips 250 can be sealingly engaged within a plurality of anchor ports 248. The anchor sub 210 can be mechanically coupled to the tubing string 136 on the uphole end of the anchor sub 210. In some embodiments, the inner surface 244 of the anchor sub 210 can be generally the same diameter as the inner surface of the tubing string 136. The anchor sub 210 can be mechanically coupled to a seal assembly 214 on the lower end or downhole end 252. The seal assembly 214 can comprise a spacer mandrel 212, a plurality of a long seal units 216, a plurality of short seal units 218, and a bottom shoe 220. The long seal unit 216 can comprise a long seal mandrel 222 comprising a generally cylinder shape with an outer surface 256 and an inner surface 258, and a seal surface 260. The long seal unit 216 can include a plurality of service seals 226 located and sealingly engaged on the seal surface 260. The service seals 226 can be a seal ring, e.g., elastomeric seal ring between backup rings, a bonded seal, e.g., elastomeric seal material bonded or molded onto a base ring, thermoplastic seal array, e.g., thermoplastic seal rings generally chevron shape arranged in a stack, or combinations thereof or any other type of suitable service seal known to the industry. The short seal unit 218 can be a shorter version on the long seal unit 216 with a seal mandrel 224 generally cylinder shaped and at least one service seal 226. The spacer mandrel 212 can be located between and mechanically couple to the anchor sub 210 and at least one seal unit, e.g., long seal unit 216. A bottom shoe 220 can be generally cylinder shape and couple to the last seal unit, e.g., seal unit 218, to act as a guide to direct the selective anchor 200 into a polish bore and provide a setting location for the selective anchoring sub.

Figure 2B:
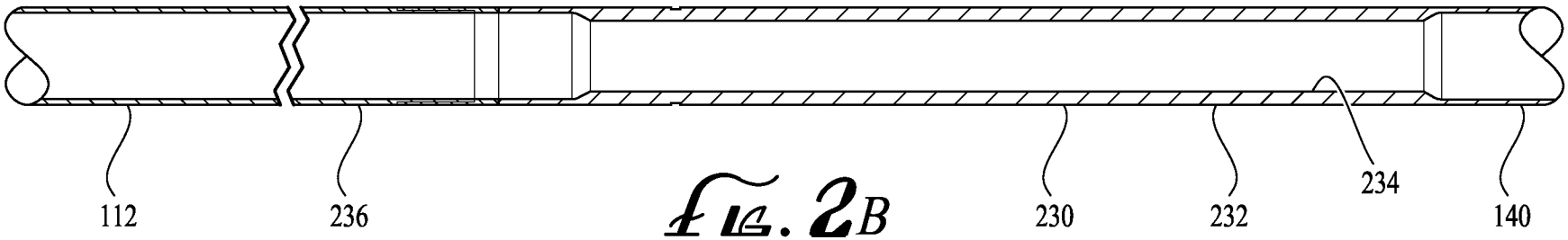
FIG. 2B is a partial cross-sectional view of a tubular joint and polish bore according to an embodiment of the disclosure.

The lower completion 140, as shown in FIG. 1, can include a seal surface 148 generally located uphole for receiving the completion interface, e.g., selective anchor 200. In some embodiments, the seal surface 148 can be located between and coupled to the casing string 112 and the lower completion 140. Turning now to FIG. 2B, a partial cross-sectional view of the seal surface can be described. In some embodiments, the seal surface, e.g., polish bore 230, can be a generally cylinder shape with an outer surface 232 and an inner surface 234. The inner surface 234 can be a seal surface configured to form a sealing engagement with the service seals 226 on the seal units, e.g., short seal unit 218. In some embodiments, a shroud 236, e.g., a tubular joint, can be coupled to the uphole end of the polish bore 230 configured to guide the selective anchor 200 into the polish bore 230.

Figure 3A:
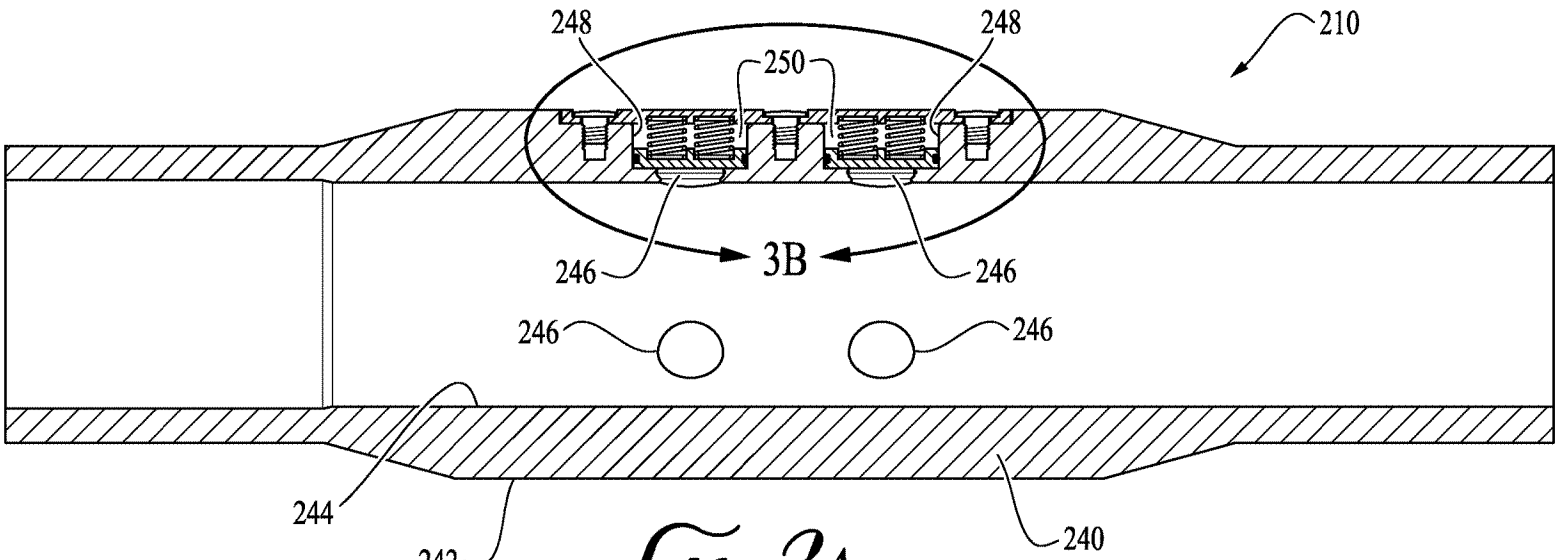
FIG. 3A is a partial cross-sectional view of the anchor sub-assembly according to an embodiment of the disclosure.

Turning now to FIG. 3A, a partial cross-sectional view of the anchor sub 210 can be described. In some embodiments, the anchor sub 210 can comprise the sub body 240, a plurality of button slips 250 within anchor ports 248, and a retaining strap 310. As previously described, the sub body 240 can be a generally cylinder shape and couple to the tubing string on the uphole end and couple to the seal assembly 214, e.g., seal interface, on the downhole end 252.

The sub body 240 can be metal, thermoplastic, composite, or any material suitable to the wellbore environment.

Figure 3B:
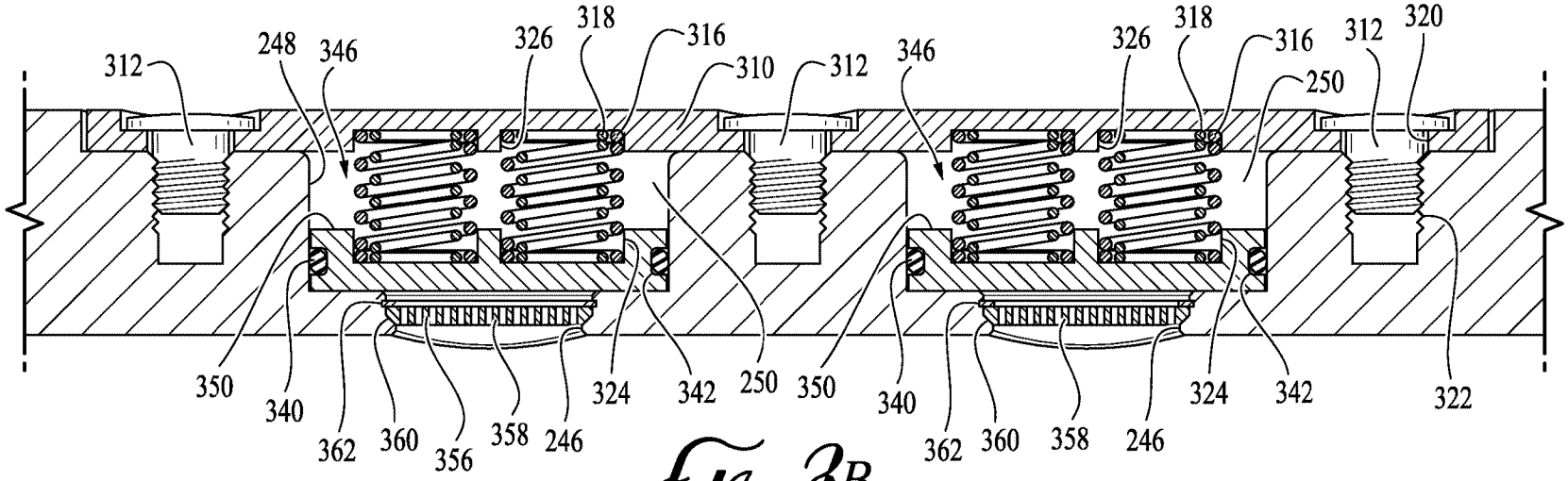
FIG. 3B is a detailed view of the anchor sub-assembly according to an embodiment of the disclosure.

Turning now to FIG. 3B, a detailed view of the anchor sub 210 can be described. In some embodiments, the plurality of button slips 250 can be retained in the sub body 240 by a retaining strap 310 and at least one retaining spring 316. The retaining strap 310 can be a generally rectangular bar shape with retaining ports 320. A plurality of retaining bolts 312 can pass through the port 320 on the retaining strap 310 to mechanically couple to a threaded port 322 in the sub body 240. The retaining spring 316 can be a compression spring configured to retain the button slip 250 within the anchor port 248. The retaining spring 316 can be installed between a first recess 324 on the button slip 250 and a second recess 326 on the retaining strap 310.

Figure 3C:
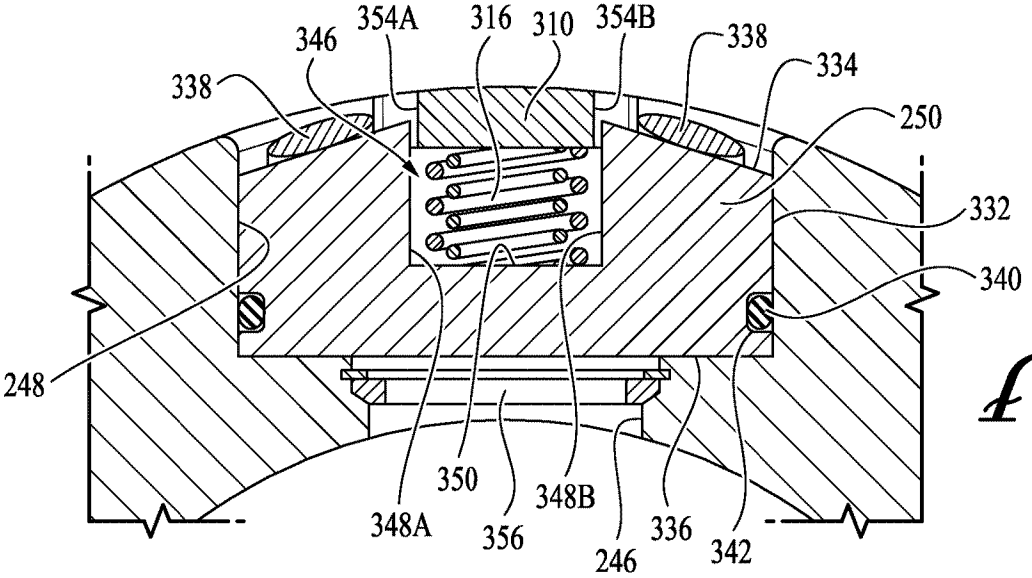
FIG. 3C is a detailed view of the button slip within the anchor sub-assembly according to an embodiment of the disclosure.
Figure 3D:
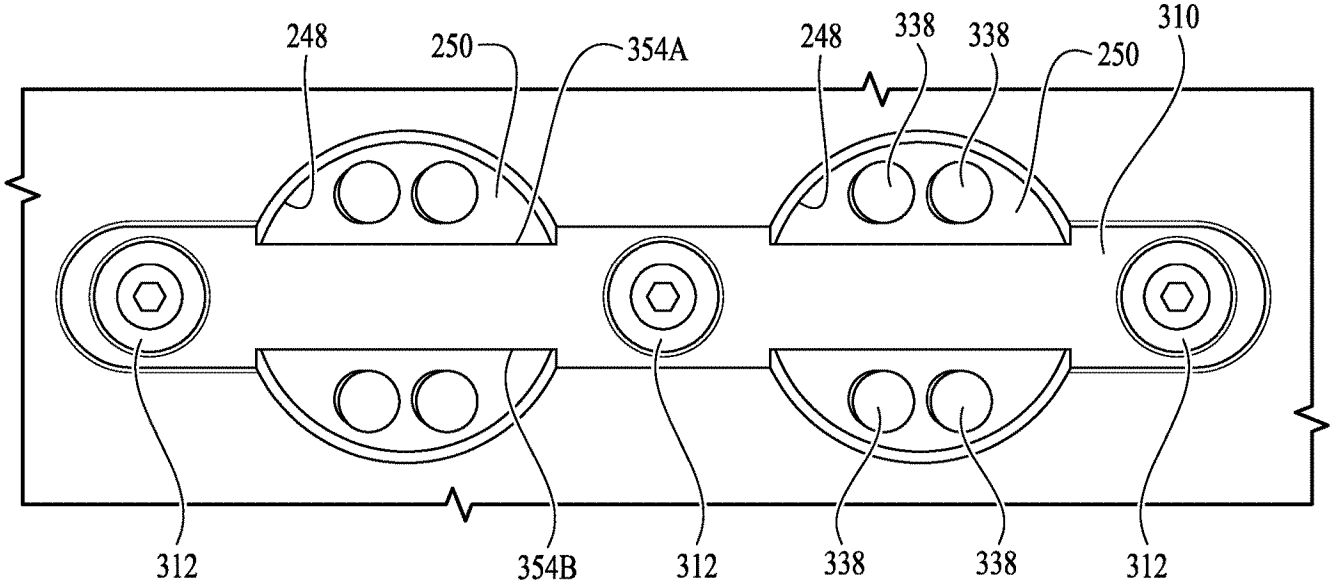
FIG. 3D is a top view of the anchor sub-assembly according to an embodiment of the disclosure.

The button slip 250 can be generally rod shaped with an anchoring feature. Turning now to FIGS. 3C and 3D, a partial cross-sectional view and atop view of the button slip 250 can be described. In some embodiments, the button slip 250 is a generally round or rod shape with an outer surface 332, a top surface 334, and a bottom surface 336. The top surface 334 can be a curved surface, e.g., a portion of a cylindrical surface, and include an anchoring feature 338, e.g., a hardened button, configured to grip or bite into the inner surface of the casing string 112. The button slip 250 can include a seal ring 340 within a circumferential groove 342 located along the outer surface 332. The seal ring 340, e.g., an O-ring, can be elastomeric, thermoplastic, or combinations thereof and configured to sealingly engage the inner surface of the anchor port 248. The retaining spring 316 can be located within an axial groove 346 comprising a first vertical surface 348A, a second vertical surface 348B, and a bottom surface 350. In some embodiments, the bottom surface 350 can include the first recess 324 for the spring 316 to be located within. The strap 310 can be configured to fit within the axial groove 346 of the button slip 250. For example, a first side 354A and a second side 354B of the strap 310 can be located with an allowance fit between the first vertical surface 348A and second vertical surface 348B of the button slip 250.

In some embodiments, the fluid port 246 can include a filter insert 356. The filter insert 356 can be a generally disk shape with a filter pattern 358 configured to exclude particulates and/or fines from entering the fluid port 246. The filter insert 356 can sealingly couple to a port shoulder 360 within the fluid port 246 of the sub body 240. The filter insert 356 can be retained on the port shoulder 360 by a retaining ring 362, a threaded ring, a snap ring, or any other suitable retaining device. The filter pattern 358 can be a plurality of holes, a woven mesh, a woven cloth, a series of welded ribs, or combinations thereof.

During operation, pressure within the anchor sub 210 can extend the plurality of button slip 250 to grip the casing string 112. Applied pressure to the interior of the anchor sub 210 can generate a pressure differential between the interior pressure and the wellbore environment, e.g., formation pressure 110. The wellbore environment within an annular space between the tubing string 136 and the wellbore 102 and/or casing string 112 can include formation pressure 110, applied pressure from surface 104, applied pressure from rig floor of the offshore platform 130, or combinations thereof. Differential pressure from within the sub body 240 can extend the button slips 250 by the piston area of the port 248 via the seals 340. The differential pressure can generate an upward force via the piston area to compress the retaining spring 316 and extend the button slip 250. The applied pressure value to extend the slips 250 can be determined by the number of springs 316 and the spring stress level of the springs 316. In some embodiments, a secondary retaining spring 318 can be utilized to increase the predetermined applied pressure value required to extend the plurality of button slips 250. The button slip 250 can anchor or grip the inner surface of the casing string and/or a shroud with the top surface 334 and/or the anchoring feature 338.

Figure 4A:
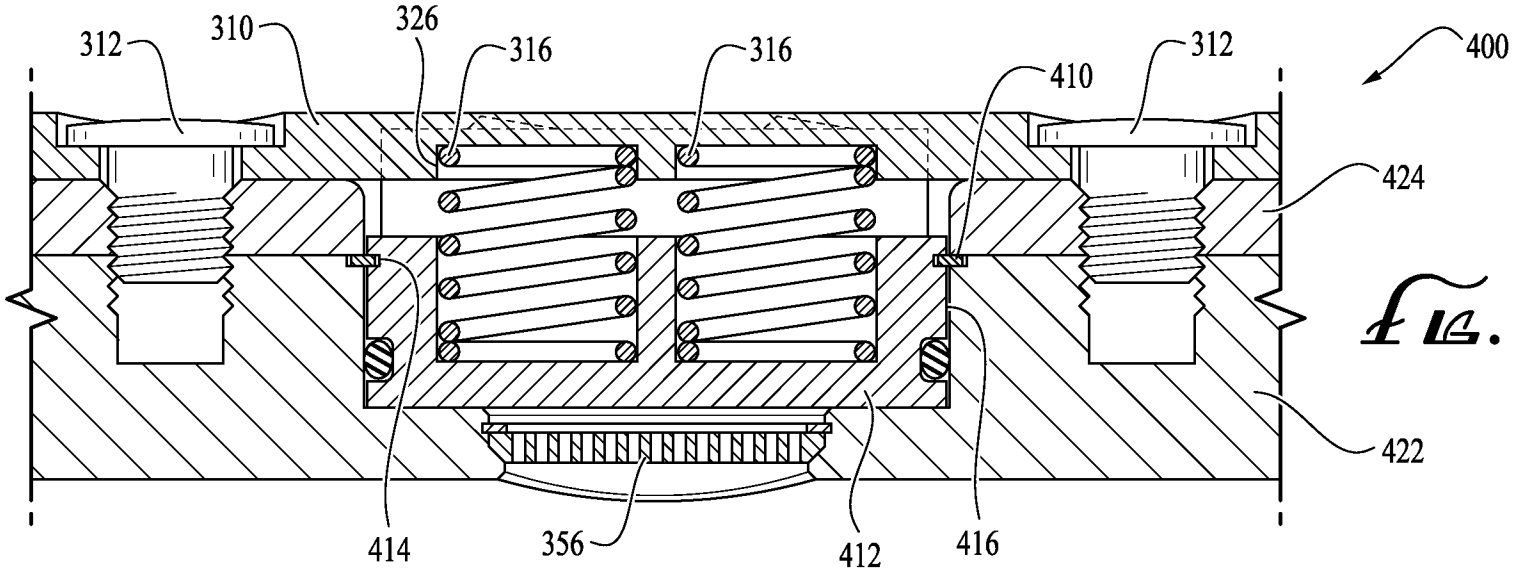
FIGS. 4A and 4B are detailed views of an alternate embodiment of the button slips within the anchor sub-assembly according to another embodiment of the disclosure.
Figure 4B:
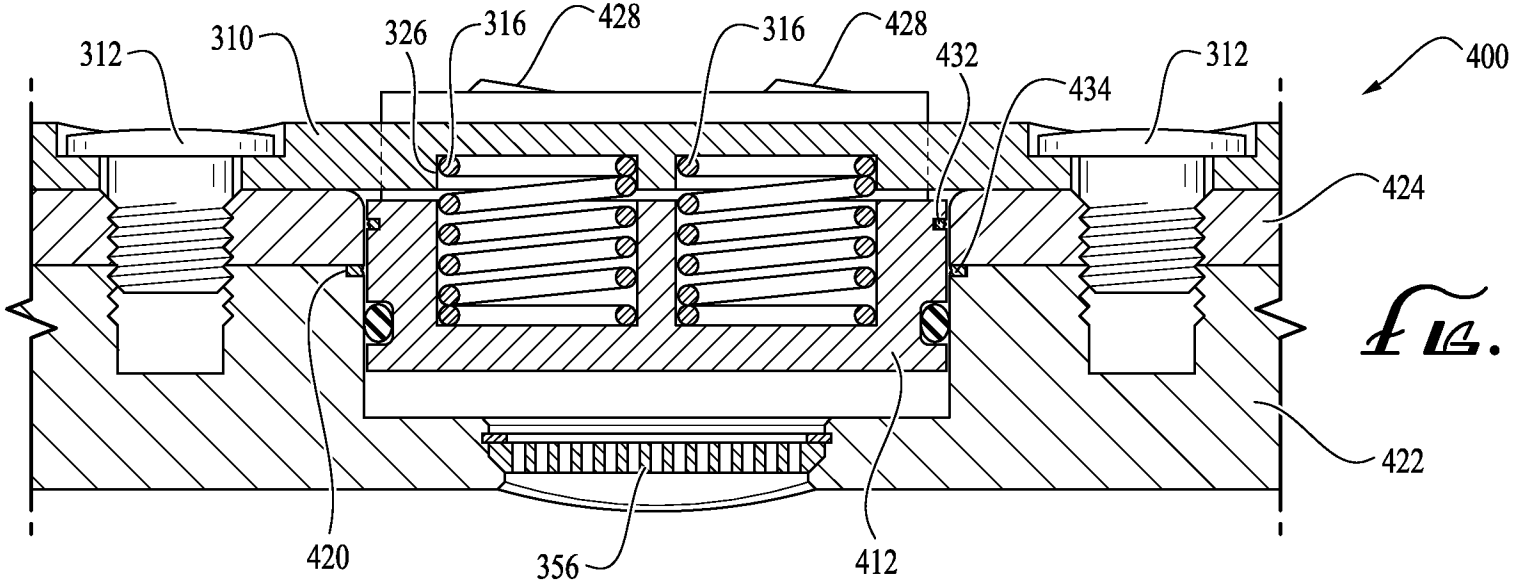

The completion operation may comprise additional completion assemblies with pressure activated mechanisms, e.g., completion packers or liner hangers. A pressure lockout device can prevent the anchor from activating until a predetermined pressure is exceeded. Turning now to FIGS. 4A and 4B, a partial cross-sectional view of a lockout mechanism can be described. In some embodiments, a lockout mechanism 400 comprises a shear ring 410 to retain the button slips 412 in the run-in position. The shear ring 410 can be a ring or a portion of a ring, e.g., arc shape, comprising a material with a controlled shear value suitable for the wellbore environment. The shear value, e.g., shear strength, can be a function of the material properties, a thickness of the material, and a cross-sectional area of the shear ring 410 that a shear force acts upon. An inner portion of the shear ring 410 can be located in a circumferential groove 414 on the outer surface 416 of the button slip 412. An outer portion of the shear ring 410 can be located in a circumferential groove 420 formed between the body sub 422 and an outer housing 424. The outer housing 424 can capture the outer portion of the shear ring 410 to hold or retain the button slip 412 in a first position or run-in position.

During operation, the lockout mechanism 400 can retain the button slip 412 in a first position. The lockout mechanism 400 can retain the button slip 412 in the first position as pressure is applied to the interior of the anchor sub, e.g., anchor sub 210, to actuate other completion assemblies. The lockout mechanism 400 can be disabled or released by applied pressure within the anchor sub exceeding a predetermined value. Applied pressure can create a differential pressure between the interior pressure and the wellbore environment to generate an upward force via the piston area, e.g., the anchor port 430. The upward force can shear the shear ring 410 into an inner portion 432 and an outer portion 434. The upward force from the pressure differential can compress the retaining spring 316, or nested retaining springs 316, 318, and extend the button slip 412. The button slip 412 can anchor or grip the inner surface of the casing string and/or a shroud with the top surface and/or the anchoring feature 428.

Turning now to FIG. 5A-5D, the operational sequence of the selective anchor 200 within the polish bore 230 can be described. In some embodiments, the selective anchor 200 can be conveyed into the wellbore 102 on the tubing string 136. The selective anchor 200 is configured to isolate the annulus 602 from the wellbore environment within the lower completion 140 and/or the tubular environment within the tubing string 136. The annulus 602 is located between the inner surface of the wellbore 102 and/or casing 112 and the outer surface of the tubing string 136.

Figures 5A, 5B, 5C, 5D:
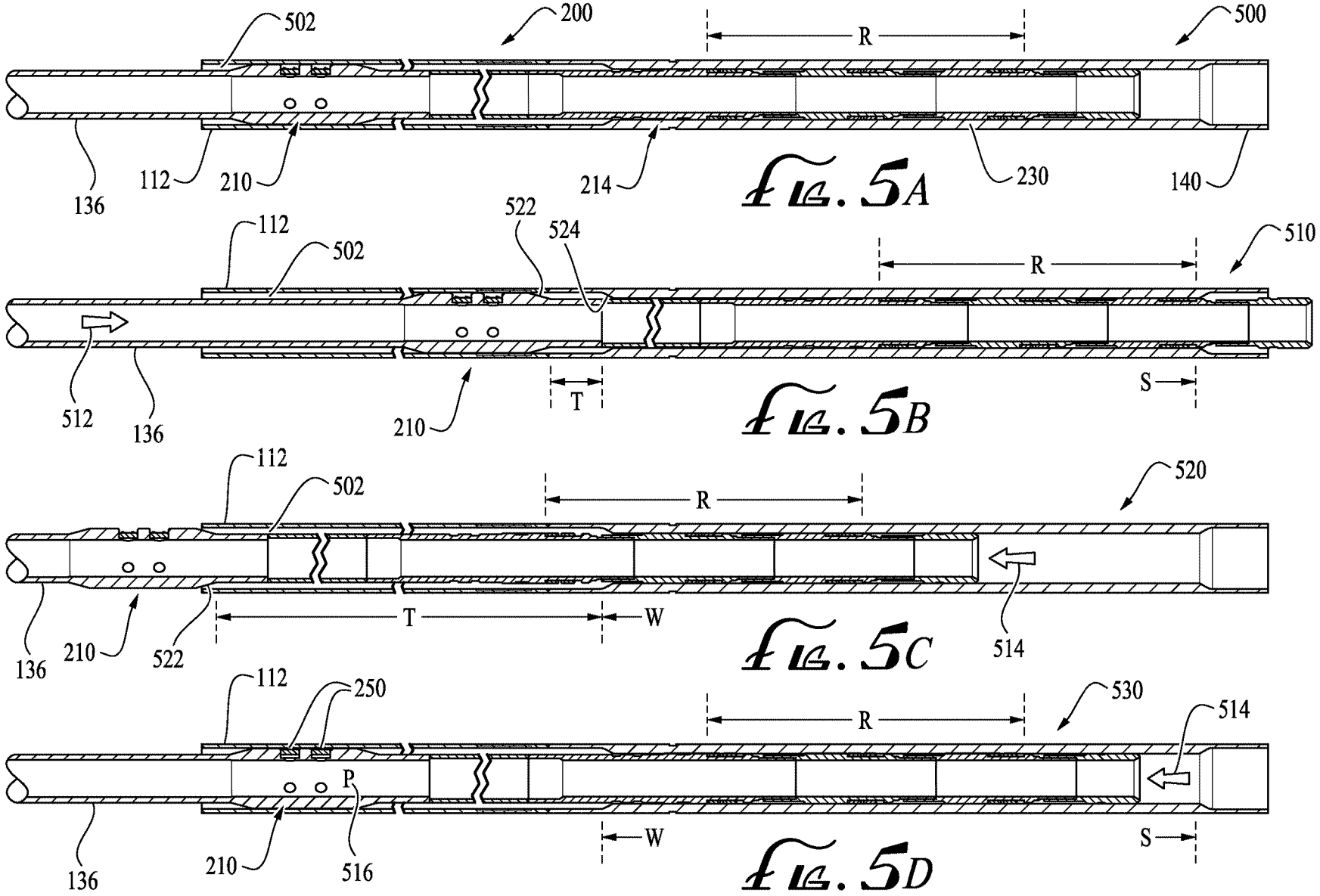
FIG. 5A is a partial cross-sectional view of a first position for the selective anchor assembly within a polish bore according to an embodiment of the disclosure.
FIG. 5B is a partial cross-sectional view of a second position for the selective anchor assembly within a polish bore according to an embodiment of the disclosure.
FIG. 5C is a partial cross-sectional view of a third position for the selective anchor assembly within a polish bore according to an embodiment of the disclosure.
FIG. 5D is a partial cross-sectional view of a fourth position for the selective anchor assembly within a polish bore according to an embodiment of the disclosure.

With reference to FIG. 5A, the completion operation can establish a first position 500 with the selective anchor 200 within the polish bore 230. The completion operation can follow a series of steps to determine and establish a first position 500 with the effective seal length "R" located in the middle of the polish bore 230. The effective seal length "R" can be defined as the axial length from the first service seal 226 to the last service seal 226 on the seal assembly 214. The selective anchor 200 can isolate the annulus 502 from the wellbore environment with a portion of the effective seal length "R" located within the polish bore 230.

With reference to FIG. 5B, the completion operation can establish a second position 510 with the selective anchor 200 within the polish bore 230. After the completion operation establishes the first position 500, the wellbore environment of the subterranean formation 110 can increase the temperature of the tubing string 136 and anchor 200. The increase in temperature of the tubing string 136 from the installation temperature to an ambient temperature can elongate the tubing string 136 via expansion generate a tubing load 512. The downward tubing load 512, e.g., compression in the downhole direction, can push or generate linear movement of the effective seal length "R" to the distal end "S" of the inner surface 234 of the polish bore 230. A portion of the effective seal length "R" may exit the distal end "S" in response to the downward force 512. The second position 510 can locate the downhole end 522 of the anchor sub 210 a distance "T" from the uphole end 524 in response to the downward tubing load 512. In some embodiments, the downward tubing load 512 can move close the distance "T" to zero when the downhole end 522 of the head 240 of the anchor sub 210 contacts the uphole end 524 of the polish bore 230. The selective anchor 200 can isolate the annulus 502 from the wellbore environment with a portion of the effective seal length "R" located within the polish bore 230.

With reference to FIG. 5C, the completion operation can establish a third position 520 with the selective anchor 200 within the polish bore 230. During a stimulation operation, the addition of treatment fluids from the surface into the wellbore environment can cool or lower the temperature of the tubing string 136 and anchor 200. The decrease in temperature of the tubing string 136 from the installation temperature to a reduced wellbore temperature can shorten the tubing string 136 via contraction to generate an upward tubing load 514. The tubing load 514 can pull or generate linear movement of the effective seal length "R" to the uphole end "W" of the inner surface 234 of the polish bore 230. A portion of the effective seal length "R" may exit the uphole end "W" in response to the upward tubing load 514, e.g., tensile force. The third position 520 can locate the downhole end 522 of the anchor sub 210 a distance "T" from the uphole end 524 in response to the upward tubing load 514, e.g., tensile force. The effective seal length "R" and the length of the polish bore from "W" to "S" can be predetermined with a design process so that the selective anchor 200 can isolate the annulus 502 from the wellbore environment with a portion of the effective seal length "R" located within the polish bore 230 in the third position 520.

With reference to FIG. 5D, the completion operation can establish a fourth position 530 with the selective anchor 200 activated and the seal assembly within the polish bore 230. In a scenario, a stimulation operation can increase the pressure within the tubing string 136 during a pumping operation. The applied pressure "P" 516 can create a pressure differential between the inside of the tubing string 136 and the annulus 502. This pressure differential can actuate the plurality of slips 250 within the anchor sub 210 to extend and grip the inner surface of the casing string 112. In some scenarios, the addition of treatment fluids from the surface into the wellbore environment can cool or lower the temperature of the tubing string 136 and anchor 200. The decrease in temperature of the tubing string 136 from the installation temperature to a reduced wellbore temperature can shorten the tubing string 136 via contraction to generate an upward tubing load 514. The activated anchor, e.g., slips 250 gripping the tubing string 136, can prevent the movement of the anchor 200 in response to the upward tubing load 514. The fourth position 530 can include an activated anchor 200 and at least a portion of the effective seal length "R" located within the polish bore 230. The selective anchor 200 can isolate the annulus 502 from the wellbore environment with a portion of the effective seal length "R" located within the polish bore 230 in the fourth position 530.

Figure 6:
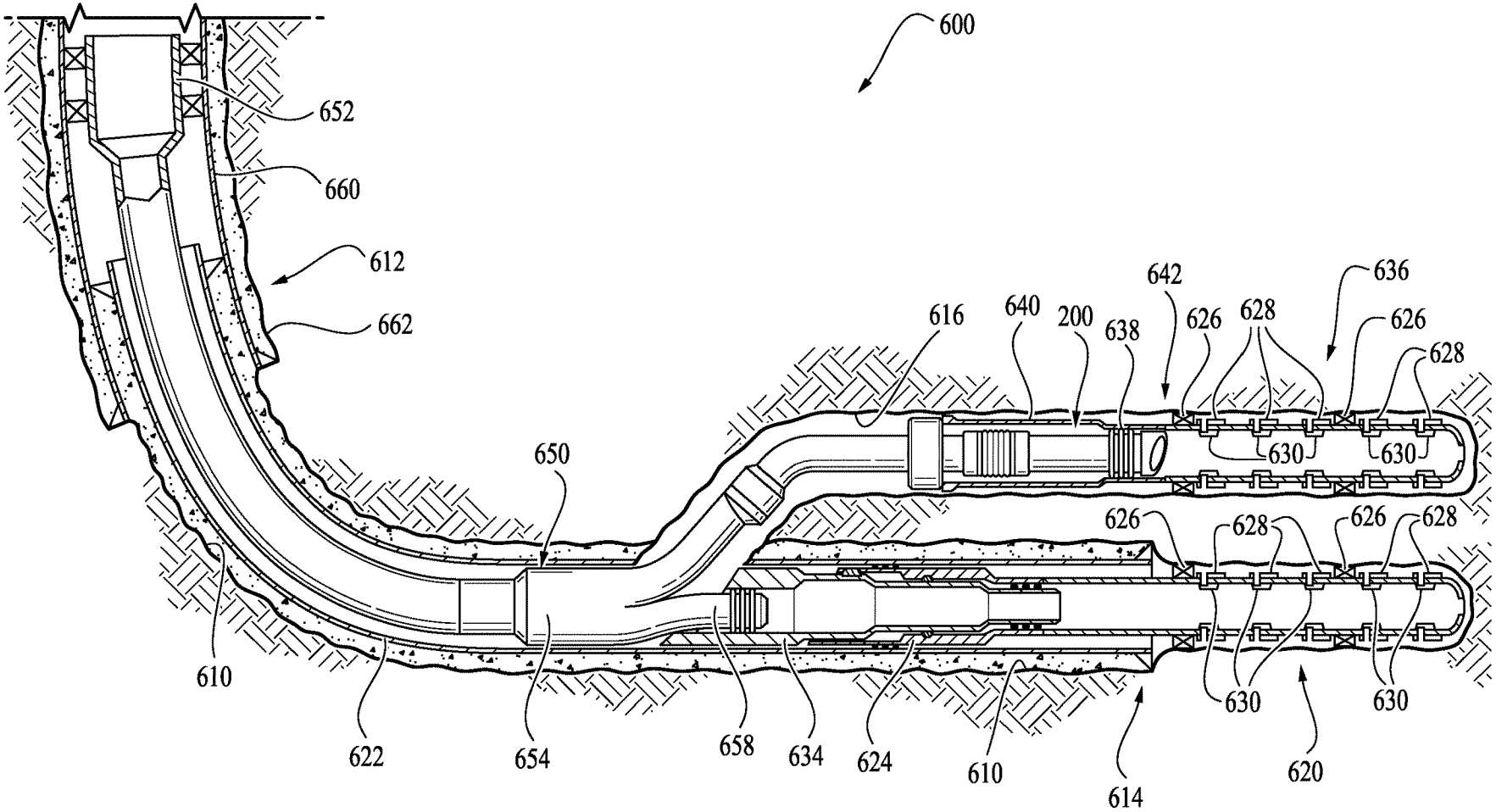
FIG. 6 is a partial cross-sectional view of a multilateral environment according to an embodiment of the disclosure.

Turning to FIG. 6, a partial cross-sectional view of a multilateral wellbore can be described. In some embodiments, selective anchor 200 may be utilized to selectively anchor and seal in multilateral wellbores, e.g., multilateral wellbore 600. Multilateral wellbore 600 generally can include a main wellbore 610 having an upper end 612 and a lower end 614 and a lateral wellbore 616. The main wellbore 610 can include a lower completion 620 with an isolation packer 624 coupled and sealed to the casing 622 of the main wellbore 610. The lower completion 620 comprises at least one zonal packer 626 and a plurality of sand screens 628 with flow valves 630. In some embodiments, a completion deflector 634 can be coupled to the lower completion 620.

In some embodiments, the lateral wellbore 616 can include a lateral completion 636 comprising a plurality of zonal packers 626 and a plurality of sand screens 628. In some embodiments, the sand screens 628 can include flow valves 630. A polish bore 638 and a shroud 640 can be coupled to the uphole end 642 of the lateral completion 636.

The selective anchor assembly can facilitate the installation of a branch completion. In some embodiments, a branch completion 650 comprises a liner hanger 652, a branch junction 654, a main junction seal 658, and the selective anchor 200.

In some embodiments, a completion operation can convey the branch completion 650 into the main wellbore 610 via a service tool and workstring. The completion deflector 634 can guide or direct the selective anchor 200 into the lateral wellbore 616. The completion operation can convey the branch completion 650 to sealingly couple the selective anchor 200 to the lateral completion 636 while simultaneously, or in a sequence of steps, coupling the main junction seal 658 to the completion deflector 634. The seal assembly 214 of the selective anchor 200 can be located in a first position 500 within the polish bore 638 of the lateral completion 636 as shown in FIG. 5A.

The completion operation can set or activate the liner hanger 652 with the service tool, e.g., a liner hanger setting tool, to sealingly engage and anchor to a primary casing string 660 within the primary wellbore 662. The completion operation can apply pressure, tension, compression, or combinations thereof during the setting of the liner hanger 652 with the liner hanger setting tool (not shown). The internal pressure applied to the branch completion 650 during the setting process can activate the selective anchor 200. As previously described and illustrated in FIG. 5D, internal pressure, e.g., pressure "P", can activate or extend the button slips 250 to grip the shroud 640 coupled to the polish bore 638 and lateral completion 636. The activation of the anchor sub 210 can configure the anchor 200 in the fourth position 530 during the completion operation to set or activate the liner hanger 652.

Figure 7:
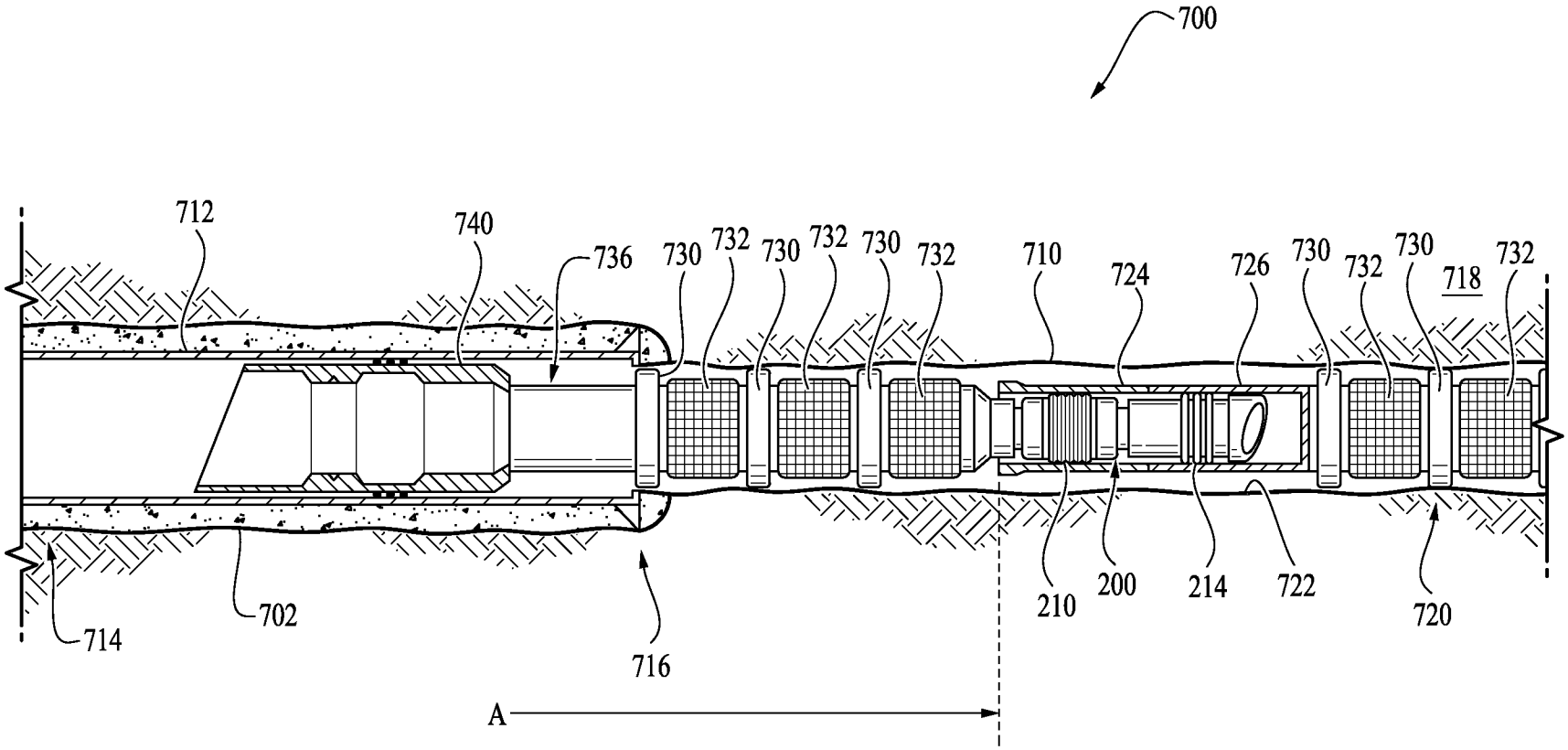
FIG. 7 is a partial cross-sectional view of a modular completion design as installed in an extended reach environment according to an embodiment of the disclosure.

Turning to FIG. 7, a partial cross-sectional view of a modular completion installed within an extended reach drilling wellbore can be described. In some embodiments, selective anchor 200 may be utilized to selectively anchor and seal in extended reach drilling (ERD) environments, e.g., ERD environment 700. An exemplary ERD wellbore 710 can extend or be drilled from a main wellbore 702 having an upper end 714 and a lower end 716. The main wellbore 702 can be an embodiment of wellbore 102 of FIG. 1 and may extend from an offshore platform 130 and/or surface location 104, thus the measured distance to "A" may comprise a water depth "C", a vertical portion "B", and a horizontal portion "A". The ERD wellbore 710 can be drilled into a subterranean formation 718 and can include a portion of a lower completion 720 comprising a shroud 724, a polish bore 726, a plurality of zonal packers 730, a plurality of sand screens 732, or combinations thereof. The zonal packers 730 can be swell type packers, compression set packers, or combinations thereof. The lower completion 720 can be installed in a portion of the main wellbore 702 that is cased or open hole 722.

In some embodiments, a modular completion 736 can be coupled to the lower completion 720 and coupled to a main casing string 712 within the main wellbore 702. The modular completion 736 comprises a liner hanger 740, a plurality of zonal packers 730, a plurality of sand screens 732, or combinations thereof and the selective anchor 200.

In some embodiments, a completion operation can convey the modular completion 736 into the main wellbore 702 via a service tool, e.g., a liner hanger setting tool, and a workstring. The completion operation can sealingly engage the polish bore 726 with the seal assembly 214 on the selective anchor 200 and, via a completion schedule comprising a number of consecutive steps, establish a first position 500 with the effective seal length "R" located in the middle of the polish bore 726.

The completion operation can set or activate the liner hanger 740 with the service tool, e.g., a liner hanger setting tool, to sealingly engage and anchor to a main casing string 712 within the main wellbore 702. The completion operation can apply pressure, tension, compression, or combinations thereof during the setting of the liner hanger 740 with the liner hanger setting tool (not shown). The internal pressure applied to the modular completion 736 during the setting process can activate the selective anchor 200. As previously described and illustrated in FIG. 5D, internal pressure, e.g., pressure "P", can activate or extend the button slips 250 to grip the shroud 724 coupled to the polish bore 726 and lower completion 720. The activation of the anchor sub 210 can configure the anchor 200 in the fourth position 530 during the completion operation to set or activate the liner hanger 740.

Figure 8A:
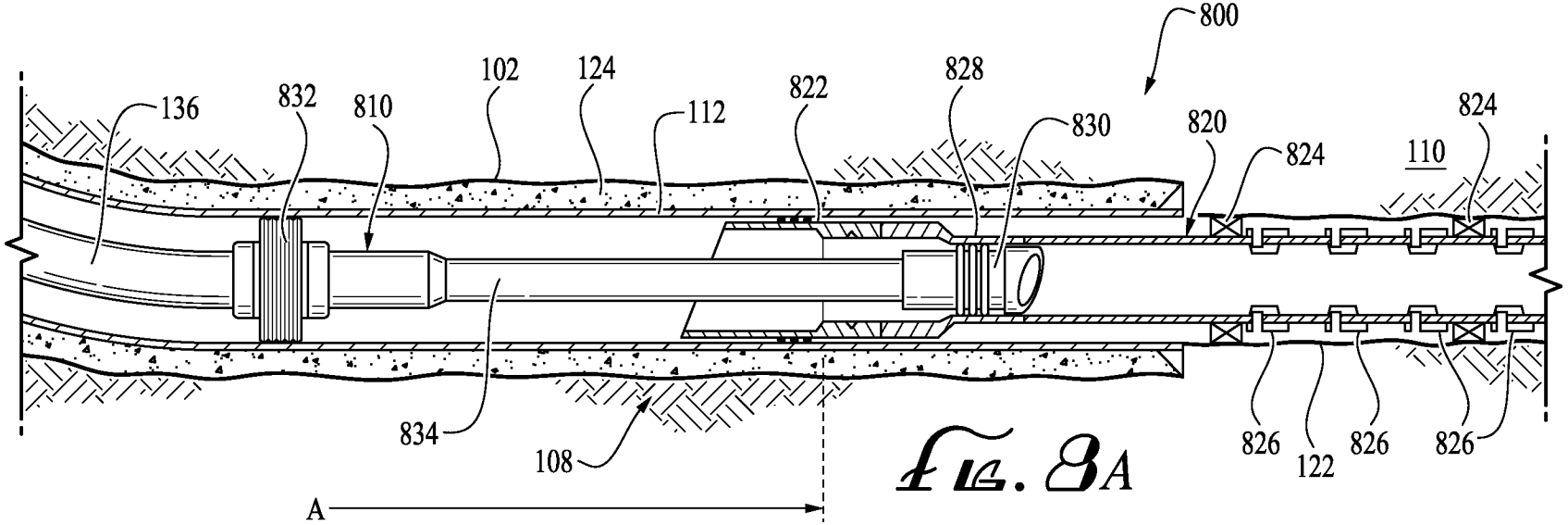
FIG. 8 is a partial cross-sectional view of a wellbore servicing environment according to an still another embodiment of the disclosure.

The selective anchor can be utilized in a wellbore servicing operation to isolate a completion. Turning to FIG. 8A, a partial cross-sectional view of a wellbore servicing operation can be described. In some embodiments, a wellbore servicing environment 800 can include removal of an upper completion 810 to access or isolate a lower completion 820. The lower completion 820 can be located in an exemplary ERD wellbore, e.g., wellbore 710, a lateral wellbore, e.g., wellbore 616, a horizontal portion, e.g., wellbore 102, or any suitable wellbore with fluidic communication to a subterranean formation, e.g., formation 110. For example, the lower completion 820 can be located in an open hole portion 122 of the horizontal section 108 of the wellbore 102 from FIG. 1 at a measured distance "A" from the rig floor. The lower completion 820 or a portion of a lower completion comprises a liner hanger 822, a plurality of zonal packers 824, a plurality of sand screens 826, or combinations thereof. The zonal packers 824 can be swell type packers, compression set packers, or combinations thereof. The sand screens 826 can include a production valve, an inflow valve, a sleeve valve, or combinations thereof. The lower completion 820 can be installed in a portion of the main wellbore 102 with the casing string 112 or open hole 122.

In some embodiments, an upper completion 810 can be coupled to the lower completion 820 by a seal assembly 830. The upper completion 810 comprises a production packer 832, an extension 834, and the seal assembly 830. Although the upper completion 810 is described as comprising a production packer 832, an extension 834, and a seal assembly 830, it is understood that the upper completion 810 can include a number of different devices with a variety of uses, for example, a sand screen, a production valve, an inflow control device, a flow control device, a plurality of sensors, a communication mechanism, a unit controller, a power source, a second packer, a third packer, or combinations thereof. In some embodiments, the tubing string 136 can be mechanically coupled to the production packer 832 or releasably coupled to the packer.

In some embodiments, a wellbore servicing operation can release and retrieve the upper completion 810. For example, the wellbore servicing operation can utilize one or more methods to convey the tubing string 136, the production packer 832, and the seal assembly 830 back to surface, e.g., platform 130.

Figure 8B:
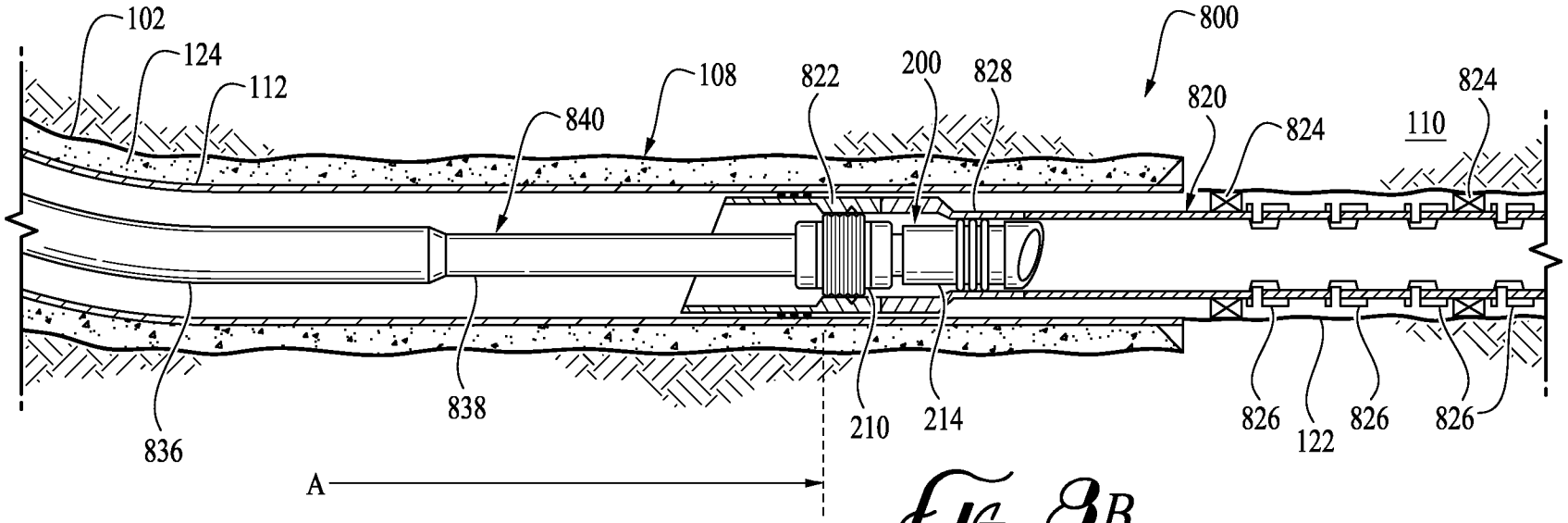

Turning now to FIG. 8B, a wellbore servicing operation can convey the anchor 200 into the wellbore 102. In some embodiments, the wellbore servicing operation can convey a service tool assembly 840 comprising an extension 838 and the selective anchor 200 via a workstring 836. The wellbore servicing operation can sealingly engage the polish bore 828 with the seal assembly 214 on the selective anchor 200 and, via an operation schedule comprising a number of consecutive steps, establish a first position 500 with the effective seal length "R" located in the middle of the polish bore 828. Although the service tool assembly 840 is described an extension 838, and the selective seal assembly 200, it is understood that the service tool assembly 840 can include a number of different devices with a variety of uses, for example, a sand screen, a service valve, a sampling device, a flow control device, a perforating gun assembly, a plurality of sensors, a communication mechanism, a unit controller, a power source, a second packer, a third packer, or combinations thereof.

The wellbore servicing operation can perform the wellbore servicing operation, e.g., perforating the casing or pumping a treatment, with the service tool assembly 840. The wellbore servicing operation can apply pressure, tension, compression, or combinations thereof during the servicing operation. The internal pressure applied to the service tool assembly 840 can activate the selective anchor 200. As previously described and illustrated in FIG. 5D, internal pressure, e.g., pressure "P", can activate or extend the button slips 250 to grip a shroud or the inner surface of the liner hanger 822 coupled to the polish bore 828 and lower completion 820. The activation of the anchor sub 210 can configure the anchor 200 in the fourth position 530 during the wellbore servicing operation.

ADDITIONAL DISCLOSURE

The following are non-limiting, specific embodiments in accordance and with the present disclosure:

A first embodiment, which is a selective anchor assembly for a downhole completion, comprising an anchor sub generally cylindrical in shape with an outer surface and an inner passage; at least one button slip sealingly coupled to a corresponding piston port on the anchor sub, wherein the corresponding piston port is fluidically coupled to the inner passage; a seal assembly coupled to the anchor sub comprising at least one seal unit; wherein the selective anchor is configured to slidingly and sealingly engage a polish bore; and wherein the selective anchor is configured to anchor to a shroud coupled to the polish bore in response to pressure applied to the inner passage of the anchor sub.

A second embodiment, which is the selective anchor assembly of the first embodiment, wherein the at least one button slip is configured in a run-in position by at least one retention spring.

A third embodiment, which is the selective anchor assembly of any of the first and the second embodiments, wherein the at least one button slip is configured to move to an anchoring position in response to an applied pressure within the inner passage of the anchor sub.

A fourth embodiment, which is the selective anchor assembly of any of the first through the third embodiments, wherein an outer surface of the button slip travels past the outer surface of the anchor sub in the anchoring position, and wherein the outer surface of the button slip grips an inner surface of the shroud in the anchoring position; and wherein the shroud is i) a generally tubular shape configured to guide the seal assembly into the polish bore, ii) a portion of the casing string, or ii) the casing string.

A fifth embodiment, which is the selective anchor assembly of the first through the fourth embodiments, wherein the seal unit comprises a seal mandrel and a service seal.

A sixth embodiment, which is the selective anchor assembly of any of the first through the fifth embodiments, wherein the seal mandrel is generally cylindrical in shape with an outer surface, an inner passage, and a seal surface; and wherein the service seal is i) an elastomeric seal, ii) a thermoplastic seal, or combinations thereof, and sealingly engaged with the seal surface of the seal mandrel.

A seventh embodiment, which is the selective anchor assembly of any of the first through the sixth embodiment, further comprising a filter insert with a filter pattern coupled to a fluid port; wherein the filter pattern is configured to exclude particulates from a wellbore fluid within the inner passage; and wherein the fluid port fluidically couples the inner passage to the corresponding piston port.

A eighth embodiment, which is the selective anchor assembly of any of the first through the seventh embodiments, wherein the wellbore fluids are i) injection fluids or ii) production fluids.

A ninth embodiment, which is the selective anchor assembly of any of the first through the eighth embodiments, wherein the applied pressure within the inner passage of the anchor sub is in response to i) a completion operation, ii) a service operation, or iii) an injection operation.

A tenth embodiment, which is a method of selectively anchoring a selective anchor assembly to a downhole completion, comprising conveying, by a tubing string, the selective anchor assembly into a wellbore of a remote wellsite; positioning a seal assembly of the selective anchor assembly in a first position within a seal surface coupled to the downhole completion, and wherein a plurality of button slips of an anchor sub are in a first position; and positioning the selective anchor assembly into a fourth position in response to a wellbore servicing operation, and wherein the plurality of button slips of the anchor sub are in a second position.

An eleventh embodiment, which is the method of the tenth embodiments, further comprising positioning, by a first temperature change, the seal assembly of the selective anchor assembly in a second position within the seal surface coupled to the downhole completion; and wherein the first temperature change is an increase in temperature of the tubing string.

A twelfth embodiment, which is the method of any of the tenth through the eleventh embodiments, wherein the plurality of button slips of the anchor sub are in the first position.

A thirteenth embodiment, which is the method of any of the tenth through the twelfth embodiments, further comprising positioning, by a second temperature change, the seal assembly of the selective anchor assembly in a third position within the seal surface coupled to the downhole completion; and wherein the second temperature change is a decrease in temperature of the tubing string.

A fourteenth embodiment, which is the method of the tenth through the thirteenth embodiment, wherein the plurality of button slips of the anchor sub are in the first position.

A fifteenth embodiment, which is the method of any of the tenth through the fourteenth embodiment, wherein the downhole completion is a lateral completion within a multilateral well.

A sixteenth embodiment, which is the method of any of the tenth through the fifteenth embodiment, wherein the downhole completion is a modular completion with an Extended Reach Drilling (ERD) well.

A seventeenth embodiment, which is the method of any of the tenth through the sixteenth embodiment, wherein the downhole completion is a lower completion within a horizontal wellbore.

A eighteenth embodiment, which is the method of any of the tenth through the seventeenth embodiment, wherein the wellbore servicing operation comprises a pumping operation; and wherein the pumping operation increases a pressure value within an inner passage of the selective anchor assembly.

A nineteenth embodiment, which is a wellbore fluid isolation tool system for a downhole completion, comprising an anchor sub generally cylindrical in shape with an outer surface and an inner passage coupled to a tubing string; at least one button slip sealingly coupled to a corresponding piston port on the anchor sub, wherein the corresponding piston port is fluidically coupled to the inner passage by a fluid port; a seal assembly coupled to the anchor sub comprising at least one seal unit, wherein the seal assembly comprises at least one seal mandrel and at least one service seal; a polish bore coupled to the downhole completion, wherein the polish bore is configured to sealingly engage the seal assembly; and wherein the wellbore fluid isolation system is configured to: establishing, by a completion operation, a first position with the seal assembly sealingly engaging the polish bore coupled to the downhole completion, wherein an annulus is formed between an outer surface of the tubing string and an inner surface of a casing string, and wherein wellbore fluids within the inner passage of the seal assembly are isolated from the annulus; and anchoring the wellbore fluid isolation system in a fourth position by activating the at least one button slip to grip the inner surface of the casing string.

A twentieth embodiment, which is the wellbore fluid isolation tool system of the nineteenth embodiment, wherein the wellbore fluid isolation system is further configured to: conveying, by a first temperature change, the seal assembly to a second position via a downhole force, wherein the first temperature change is an increase in a temperature of the tubing string, and wherein the downhole force is in response to an elongation of the tubing string in response to the first temperature change.

A twenty-first embodiment, which is the wellbore fluid isolation tool system of the nineteenth and twentieth embodiment, wherein the wellbore fluid isolation system is further configured to: conveying, by a second temperature change, the seal assembly to a third position via an uphole force, wherein the second temperature change is a decrease in a temperature of the tubing string, and wherein the uphole force is in response to a contraction of the tubing string in response to the second temperature change.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A selective anchor assembly for a downhole completion, comprising:

an anchor sub comprising a generally cylindrical shape, an outer surface, and an inner passage;

at least one button slip sealingly coupled to a corresponding piston port on the anchor sub, wherein the corresponding piston port is fluidically coupled to the inner passage; and a seal assembly coupled to the anchor sub, comprising at least one seal unit, and configured to transition from a first position to a second position in response to a temperature change, wherein the selective anchor assembly is configured to slidingly and sealingly engage a polish bore, and anchor to a shroud coupled to the polish bore in response to pressure applied to the inner passage, and wherein the transition from the first position to the second position comprises reducing a distance between a downhole end of the anchor sub and an uphole end of the polish bore.

2. The selective anchor assembly of claim 1, wherein the at least one button slip is configured in a run-in position by at least one retention spring.

3. The selective anchor assembly of claim 1, wherein the at least one button slip is configured to move to an anchoring position in response to an applied pressure within the inner passage of the anchor sub.

4. The selective anchor assembly of claim 3, wherein an outer surface of the at least one button slip is configured to travel past the outer surface of the anchor sub in the anchoring position, and the outer surface of the at least one button slip is configured to grip an inner surface of the shroud in the anchoring position.

5. The selective anchor assembly of claim 1, wherein the at least one seal unit comprises a seal mandrel and a service seal.

6. The selective anchor assembly of claim 5, wherein the seal mandrel comprises a generally cylindrical shape, an outer surface, an inner passage, and a seal surface, and the service seal is an elastomeric seal or a thermoplastic seal, and the service seal is sealingly engaged with the seal surface of the seal mandrel.

7. The selective anchor assembly of claim 1, further comprising:

a filter insert comprising a filter pattern coupled to a fluid port, wherein the filter pattern is configured to exclude particulates from wellbore fluids within the inner passage, and wherein the fluid port fluidically couples the inner passage to the corresponding piston port.

8. The selective anchor assembly of claim 7, wherein the wellbore fluids are injection fluids or production fluids.

9. The selective anchor assembly of claim 1, wherein the temperature change comprises a transition from a first temperature of a tubing string to a second temperature of the tubing string, the second temperature is greater than the first temperature, and the tubing string is configured to convey the selective anchor assembly into the wellbore.

10. The selective anchor assembly of claim 1, wherein the transition from the first position to the second position comprises an axial translation of the anchor sub within the polish bore.

11. The selective anchor assembly of claim 1, wherein the anchor sub is coupled to a tubing string, the seal assembly is configured to sealingly engaging the polish bore, which is coupled to the downhole completion, and an annulus is formed between an outer surface of the tubing string and an inner surface of a casing string.

12. A method of selectively anchoring a selective anchor assembly to a downhole completion, comprising:

conveying, by a tubing string, the selective anchor assembly into a wellbore of a remote wellsite;

positioning a seal assembly of the selective anchor assembly in a first position within a seal surface coupled to the downhole completion such that a plurality of button slips of an anchor sub are in a first position;

positioning, by a first temperature change, the seal assembly of the selective anchor assembly in a second position within the seal surface coupled to the downhole completion, wherein the first temperature change is an increase in temperature of the tubing string; and positioning the selective anchor assembly into a fourth position, in response to a wellbore servicing operation, such that the plurality of button slips of the anchor sub are in a second position.

13. The method of claim 12, wherein the plurality of button slips of the anchor sub are in the first position when the seal assembly is positioned by the first temperature change.

14. The method of claim 12, further comprising:

positioning, by a second temperature change, the seal assembly of the selective anchor assembly in a third position within the seal surface coupled to the downhole completion, wherein the second temperature change is a decrease in temperature of the tubing string.

15. The method of claim 14, wherein the plurality of button slips of the anchor sub are in the first position when the seal assembly is positioned by the second temperature change.

16. The method of claim 12, wherein the downhole completion is a lateral completion within a multilateral well.

17. The method of claim 12, wherein the downhole completion is a modular completion within an Extended Reach Drilling (ERD) well.

18. The method of claim 12, wherein the downhole completion is a lower completion within a horizontal wellbore.

19. The method of claim 12, wherein the wellbore servicing operation comprises a pumping operation, and the pumping operation increases a pressure value within an inner passage of the selective anchor assembly.

20. A wellbore fluid isolation system for a downhole completion, comprising:

an anchor sub comprising a generally cylindrical shape, an outer surface, and an inner passage coupled to a tubing string;

at least one button slip sealingly coupled to a corresponding piston port on the anchor sub, wherein the corresponding piston port is fluidically coupled to the inner passage by a fluid port;

a seal assembly coupled to the anchor sub and comprising at least one seal unit, at least one seal mandrel, and at least one service seal; and a polish bore coupled to the downhole completion, wherein the polish bore is configured to sealingly engage the seal assembly, wherein the wellbore fluid isolation system is configured to:

establish, by a completion operation, a first position with the seal assembly sealingly engaging the polish bore coupled to the downhole completion, wherein an annulus is formed between an outer surface of the tubing string and an inner surface of a casing string, and wherein wellbore fluid within the inner passage is isolated from the annulus;

convey, by a first temperature change, the seal assembly to a second position via a downhole force, wherein the first temperature change is an increase in a temperature of the tubing string, and wherein the downhole force is in response to an elongation of the tubing string in response to the first temperature change; and anchor the wellbore fluid isolation system in a fourth position by activating the at least one button slip to grip the inner surface of the casing string.

21. The wellbore fluid isolation system of claim 20, wherein the wellbore fluid isolation system is further configured to convey, by a second temperature change, the seal assembly to a third position via an uphole force, wherein the second temperature change is a decrease in a temperature of the tubing string, and wherein the uphole force is in response to a contraction of the tubing string in response to the second temperature change.

22. A method of selectively anchoring a selective anchor assembly to a downhole completion, comprising:

conveying, by a tubing string, the selective anchor assembly into a wellbore of a remote wellsite;

positioning a seal assembly of the selective anchor assembly in a first position within a seal surface coupled to the downhole completion such that a plurality of button slips of an anchor sub are in a first position;

positioning, by a second temperature change, the seal assembly of the selective anchor assembly in a third position within the seal surface coupled to the downhole completion, wherein the second temperature change is a decrease in temperature of the tubing string; and positioning the selective anchor assembly into a fourth position, in response to a wellbore servicing operation, such that the plurality of button slips of the anchor sub are in a second position.

23. A wellbore fluid isolation system for a downhole completion, comprising:

an anchor sub comprising a generally cylindrical shape, an outer surface, and an inner passage coupled to a tubing string;

at least one button slip sealingly coupled to a corresponding piston port on the anchor sub, wherein the corresponding piston port is fluidically coupled to the inner passage by a fluid port;

a seal assembly coupled to the anchor sub and comprising at least one seal unit, at least one seal mandrel, and at least one service seal; and a polish bore coupled to the downhole completion, wherein the polish bore is configured to sealingly engage the seal assembly, wherein the wellbore fluid isolation system is configured to:

establish, by a completion operation, a first position with the seal assembly sealingly engaging the polish bore coupled to the downhole completion, wherein an annulus is formed between an outer surface of the tubing string and an inner surface of a casing string, and wherein wellbore fluid within the inner passage is isolated from the annulus;

convey, by a second temperature change, the seal assembly to a third position via an uphole force, wherein the second temperature change is a decrease in a temperature of the tubing string, and wherein the uphole force is in response to a contraction of the tubing string in response to the second temperature change; and anchor the wellbore fluid isolation system in a fourth position by activating the at least one button slip to grip the inner surface of the casing string.

24. A selective anchor assembly for a downhole completion, comprising:

an anchor sub comprising a generally cylindrical shape, an outer surface, and an inner passage;

at least one button slip sealingly coupled to a corresponding piston port on the anchor sub, wherein the corresponding piston port is fluidically coupled to the inner passage; and a seal assembly coupled to the anchor sub, comprising at least one seal unit, and configured to transition from a first position to a second position in response to a temperature change, wherein the selective anchor assembly is configured to slidingly and sealingly engage a polish bore, and anchor to a shroud coupled to the polish bore in response to pressure applied to the inner passage, and wherein the transition from the first position to the second position comprises an axial translation of the anchor sub within the polish bore.

* * * * *